US010763603B2

(12) United States Patent
Guo et al.

(10) Patent No.: US 10,763,603 B2
(45) Date of Patent: Sep. 1, 2020

(54) ELECTRONIC CARD CONNECTOR AND ELECTRONIC CARD CONNECTOR ASSEMBLY THEREOF

(71) Applicant: QIDONG LINKCONN ELECTRONICS CO., LTD., Qidong, Jiangsu (CN)

(72) Inventors: Jiangang Guo, Qidong (CN); Zhaohui Zhu, Qidong (CN)

(73) Assignee: QIDONG LINKCONN ELECTRONICS CO., LTD., Qidong (CN)

( * ) Notice: Subject to any disclaimer, the term of this patent is extended or adjusted under 35 U.S.C. 154(b) by 0 days.

(21) Appl. No.: 16/746,865

(22) Filed: Jan. 18, 2020

(65) Prior Publication Data

US 2020/0153132 A1 May 14, 2020

Related U.S. Application Data

(63) Continuation of application No. PCT/CN2018/097168, filed on Jul. 26, 2018.

(30) Foreign Application Priority Data

Aug. 4, 2017 (CN) ..... 2017 1 0665387
Aug. 4, 2017 (CN) ..... 2017 1 0665441

(51) Int. Cl.
*H01R 12/70* (2011.01)
*H01R 12/51* (2011.01)
(Continued)

(52) U.S. Cl.
CPC ..... *H01R 12/7076* (2013.01); *H01R 12/51* (2013.01); *H01R 12/721* (2013.01);
(Continued)

(58) Field of Classification Search
CPC ..... H01R 12/7076; H01R 13/2442; H01R 13/631; H01R 13/405; H01R 12/51;
(Continued)

(56) References Cited

U.S. PATENT DOCUMENTS

| | | | | |
|---|---|---|---|---|
| 8,308,514 | B1 | 11/2012 | Su et al. | |
| 10,547,144 | B2 * | 1/2020 | Mikawa | H01R 13/635 |
| 10,594,348 | B2 * | 3/2020 | Yang | G06K 7/0052 |
| 2005/0085116 | A1 * | 4/2005 | Washino | G06K 7/0047 439/326 |

(Continued)

FOREIGN PATENT DOCUMENTS

| | | | |
|---|---|---|---|
| CN | 101752697 | A | 6/2010 |
| CN | 102842787 | A | 12/2012 |

(Continued)

*Primary Examiner* — Travis S Chambers

(57) ABSTRACT

An electronic card connector includes an insulative housing defining an accommodating cavity receiving a card tray and having a first base body, a number of conductive terminals, and a shielding shell. The terminals define an array of first contacts and an array of second contacts respectively located in two sides. Each terminal has an affixed portion, a contacting portion extending into the accommodating cavity, and a soldering portion extending outside of the insulative housing. The insulative housing is inject-molded with the first contacts and the shielding shell, and the first contacts are configured as same as the second contacts in a rotationally symmetrical direction in 180 degree so that disregarding the insertion orientations of the card tray, the conductive terminals are always electrically connected with pins of the electronic card correctly.

19 Claims, 13 Drawing Sheets

(51) Int. Cl.

| | |
|---|---|
| ***H01R 13/24*** | (2006.01) |
| ***H01R 13/405*** | (2006.01) |
| ***H01R 13/631*** | (2006.01) |
| ***H01R 13/6581*** | (2011.01) |
| ***H01R 12/72*** | (2011.01) |

(52) U.S. Cl.
CPC ..... *H01R 13/2442* (2013.01); *H01R 13/405* (2013.01); *H01R 13/631* (2013.01); *H01R 13/6581* (2013.01)

(58) Field of Classification Search
CPC ..... H01R 13/6581; H01R 13/6594; H01R 13/26; H01R 13/642; H01R 12/732; H01R 12/718
USPC ..... 439/68, 377, 630, 636, 637, 607.35, 439/607.36, 607.39, 607.4
See application file for complete search history.

(56) References Cited

U.S. PATENT DOCUMENTS

| | | | | |
|---|---|---|---|---|
| 2017/0012376 | A1* | 1/2017 | Nakase | G06K 7/0021 |
| 2017/0093057 | A1* | 3/2017 | Wang | G06K 7/0034 |
| 2019/0272453 | A1* | 9/2019 | Argyres | H04B 1/3816 |

FOREIGN PATENT DOCUMENTS

| | | | | |
|---|---|---|---|---|
| CN | 103633478 | A | 3/2014 | |
| CN | 203747193 | U | 7/2014 | |
| CN | 203787603 | U | 8/2014 | |
| CN | 104638485 | A | 5/2015 | |
| CN | 204558701 | U | 8/2015 | |
| CN | 106450844 | A | 2/2017 | |
| CN | 104425920 | B | 5/2017 | |
| CN | 206370562 | U | 8/2017 | |
| CN | 107465011 | A | 12/2017 | |
| CN | 206976631 | U | 2/2018 | |
| WO | WO-2017116206 | A1 * | 7/2017 | G06K 7/0052 |

* cited by examiner

ELECTRONIC CARD CONNECTOR AND ELECTRONIC CARD CONNECTOR ASSEMBLY THEREOF

TECHNICAL FIELD

The present disclosure relates to an electronic card connector, and more particularly to a miniaturized and reversible electronic card connector and electronic card connector assembly thereof.

BACKGROUND

China Patent No. 101752697 discloses a stacked card connector including a main base, a number of contacts retained in the insulative housing, and a shell enclosing the main base and forming a cavity therebetween to receive a card. The main base includes a first base portion and a second base portion below the first base portion. Each contact has a contacting portion extending into the cavity and electrically connected with the corresponding card. However, the cavity of the stacked card connector is divided into two parts in a vertical direction, which increases height of the connector and make it inconvenient to insert the card in two sides.

China Patent No. 104425920 discloses an electronic card connector including an insulating body, a number of conductive terminals retained in the insulating body, and a drawer base cooperated with the insulating body. The insulating body has an accommodating cavity in which the drawer base acts. The drawer base is provided with a first accommodating space and a second accommodating space. The conductive terminals include a number of first conductive terminals and a number of second conductive terminals used for mating with different electronic cards. The first conductive terminals and the second conductive terminals are respectively disposed in corresponding the first accommodating space and the second accommodating space, and the first accommodating space and the second accommodating space are separated from each other. The electronic card connector can accommodate multiple electronic cards at the same time to ensure that an electronic device has a preferred size with the electronic card connector. The first accommodating space and the second accommodating space are arranged in a front-to-back direction, which decreased the height of the connector and increased the length of space in the electronic device occupied by the connector. Meanwhile, the structure of the drawer is a disadvantage to be inserted into the connector in two sides.

Hence, a new and simple electronic card connector and electronic card connector assembly thereof are desired to improve those disclosed in the aforementioned proposal.

SUMMARY OF THE INVENTION

Accordingly, the object of the present disclosure is an electronic card connector, used for receiving a card tray able to receive an electronic card either in two sides, comprise an insulative housing defining an accommodating cavity receiving the card tray and having a first base body, a plurality of conductive terminals retained in the insulative housing and defining an array of first contacts and an array of second contacts respectively located in two sides of the insulative housing in a vertical direction and a shielding shell attached to the insulative housing. Each terminal has an affixed portion retained in the insulative housing, a contacting portion extending into the accommodating cavity from the affixed portion, and a soldering portion extending outside of the insulative housing. The insulative housing is injectmolded with the first contacts and the shielding shell, and the first contacts are configured as same as the second contacts in a rotationally symmetrical direction in 180 degree, disregarding the insertion orientations of the card tray, the conductive terminals are always electrically connected with pins of the electronic card correctly.

Other objects, advantages and novel features of the disclosure will become more apparent from the following detailed description when taken in conjunction with the accompanying drawings.

DETAILED DESCRIPTION

Reference will now be made in detail to the preferred embodiment of the present disclosure.

Figure 1:
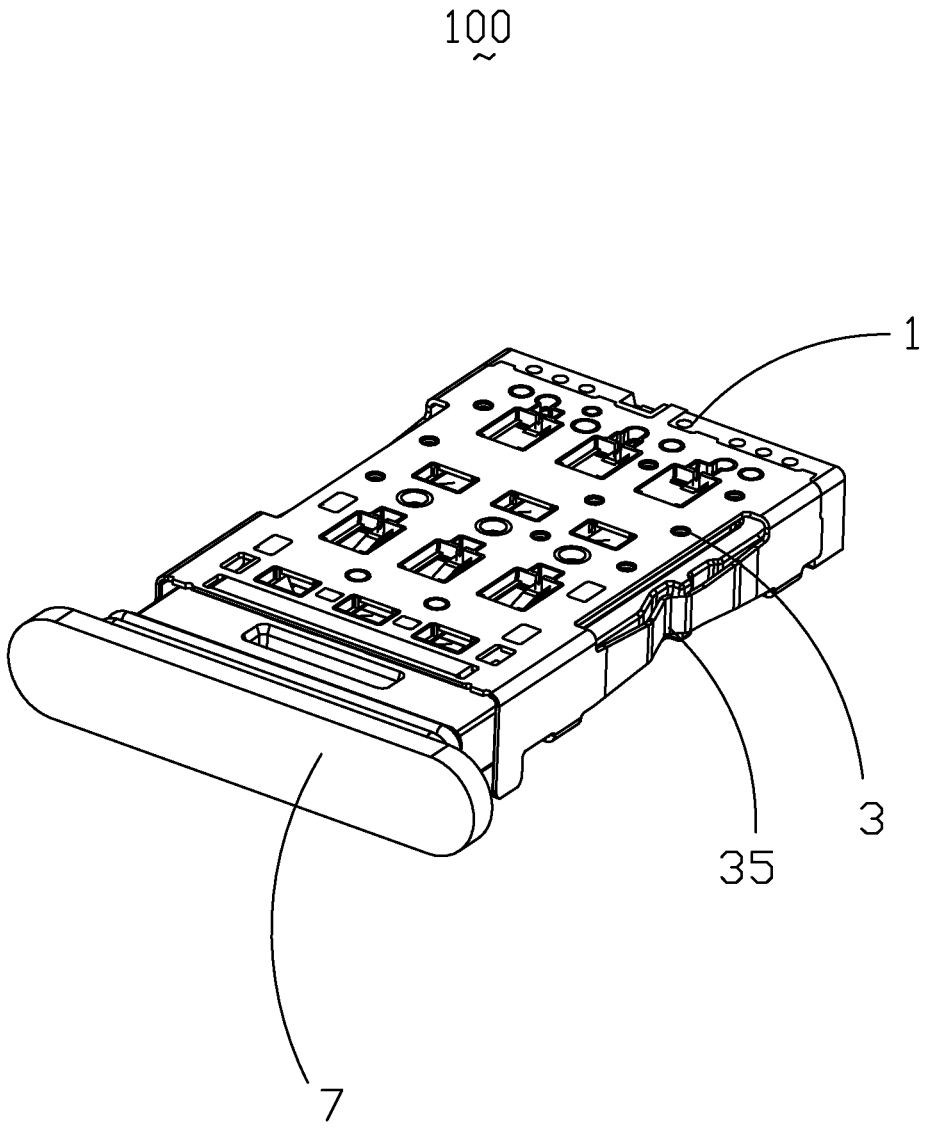
FIG. 1 is an assembled perspective view of an electronic card connector assembly in a first embodiment.
Figure 2:
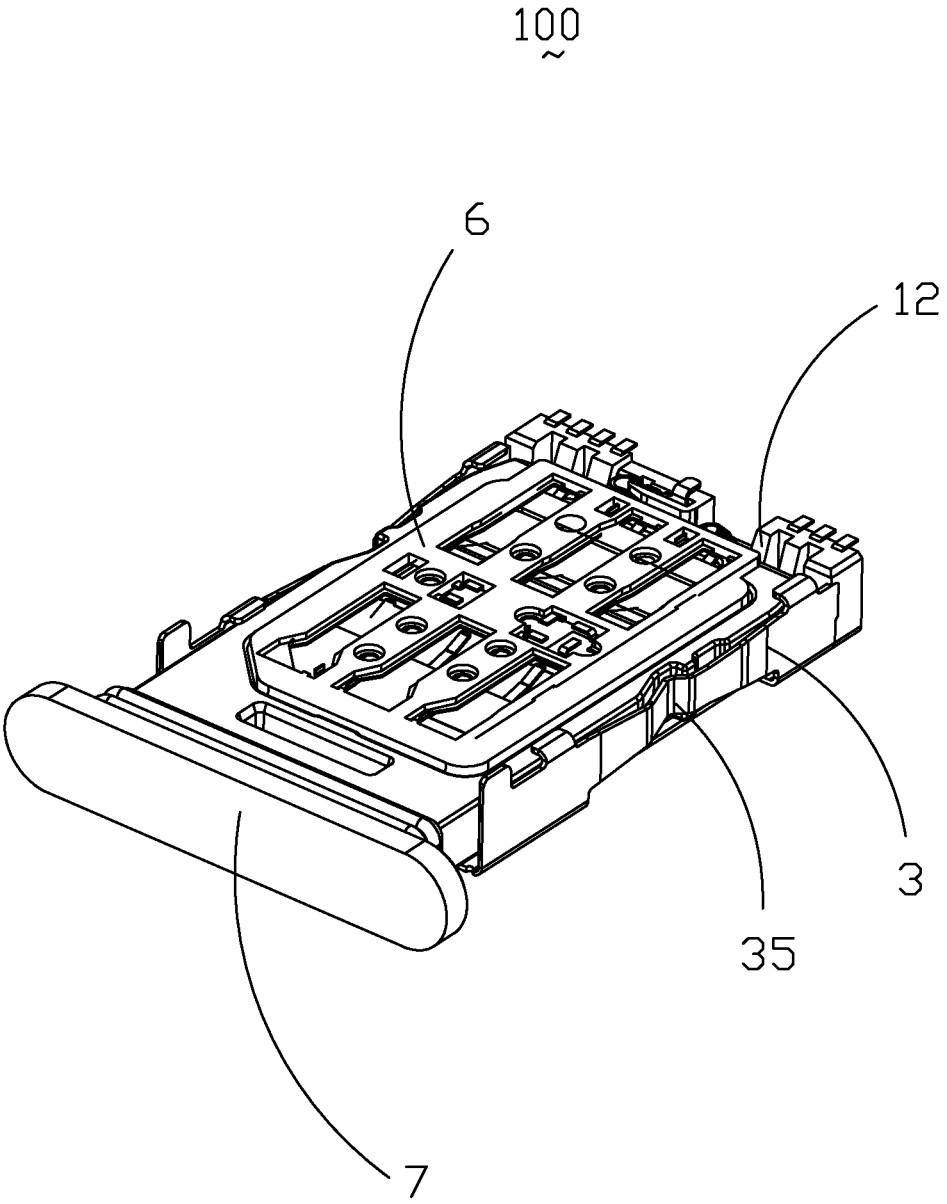
FIG. 2 is another assembled perspective view of the electronic card connector assembly of FIG. 1.
Figure 3:
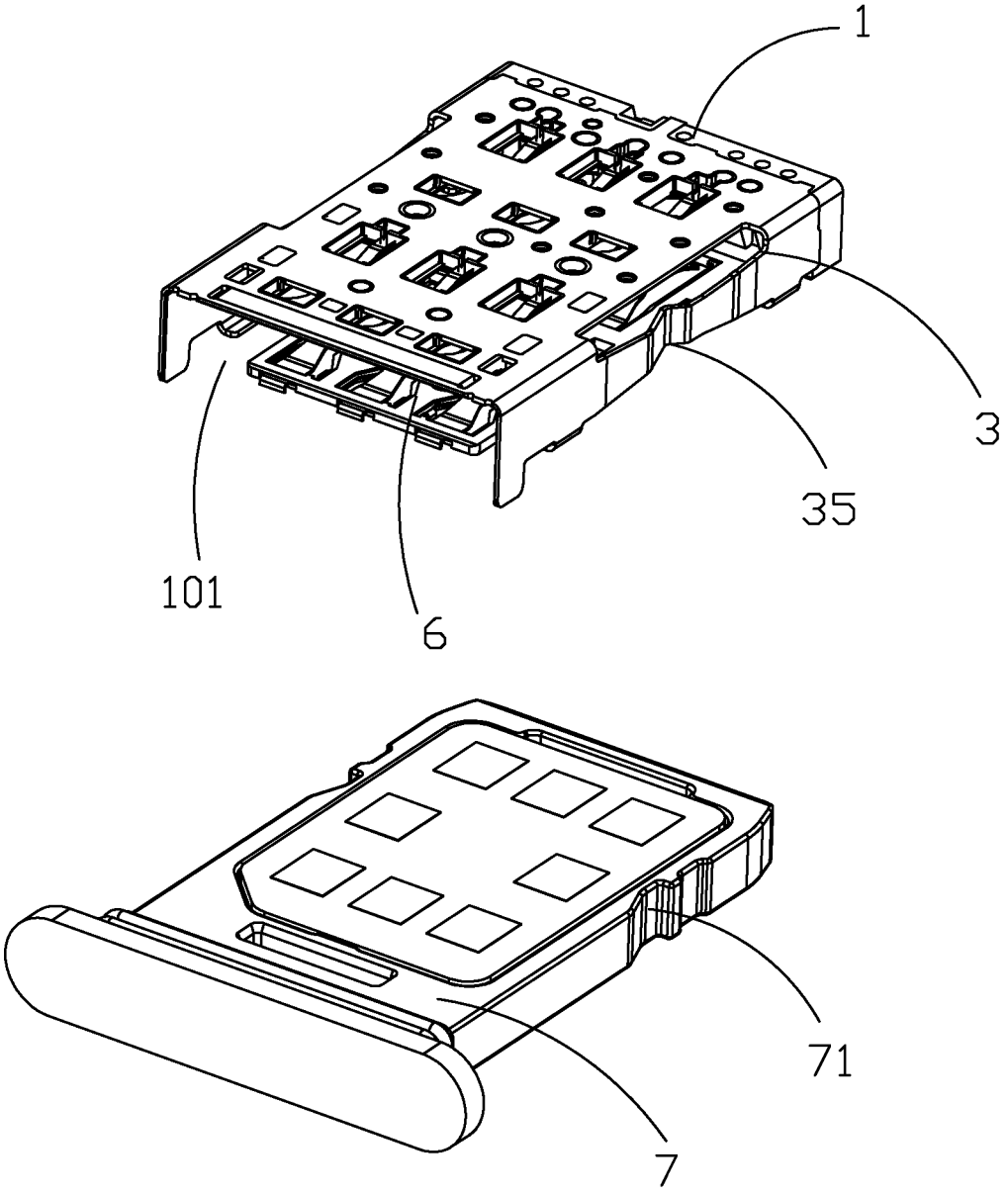
FIG. 3 is a partially exploded perspective view of the electronic card connector assembly of FIG. 1.
Figure 4:
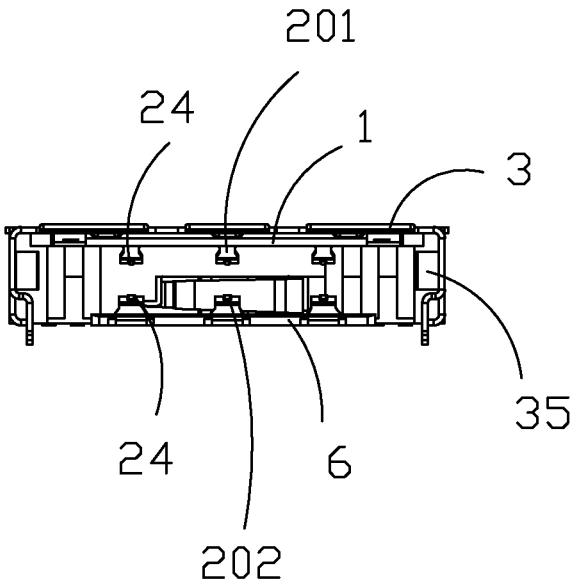
FIG. 4 is a front perspective view of an electronic card connector of the electronic card connector assembly of FIG. 1.
Figure 5:
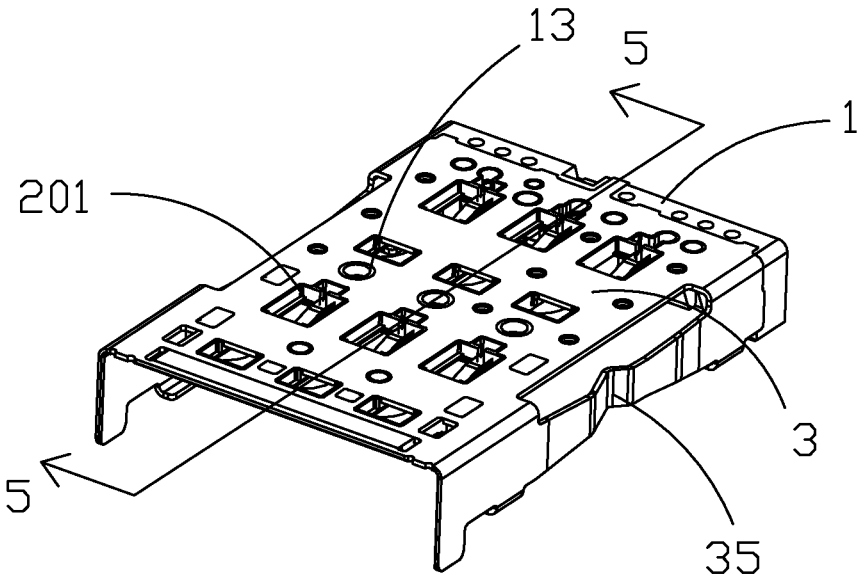
FIG. 5 is a partially exploded perspective view of the electronic card connector.
Figure 5:
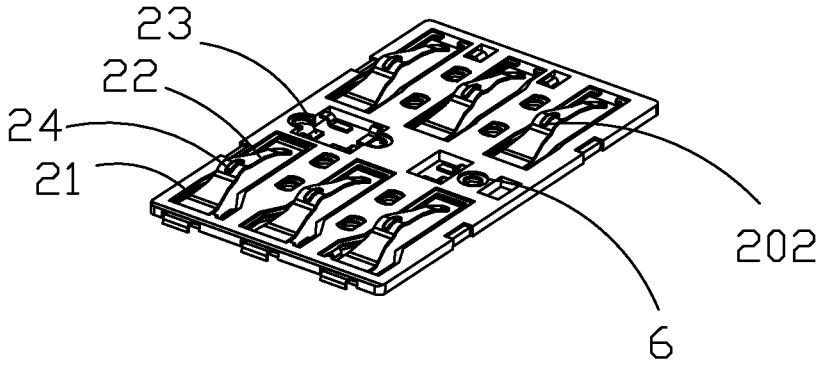
Figure 6:
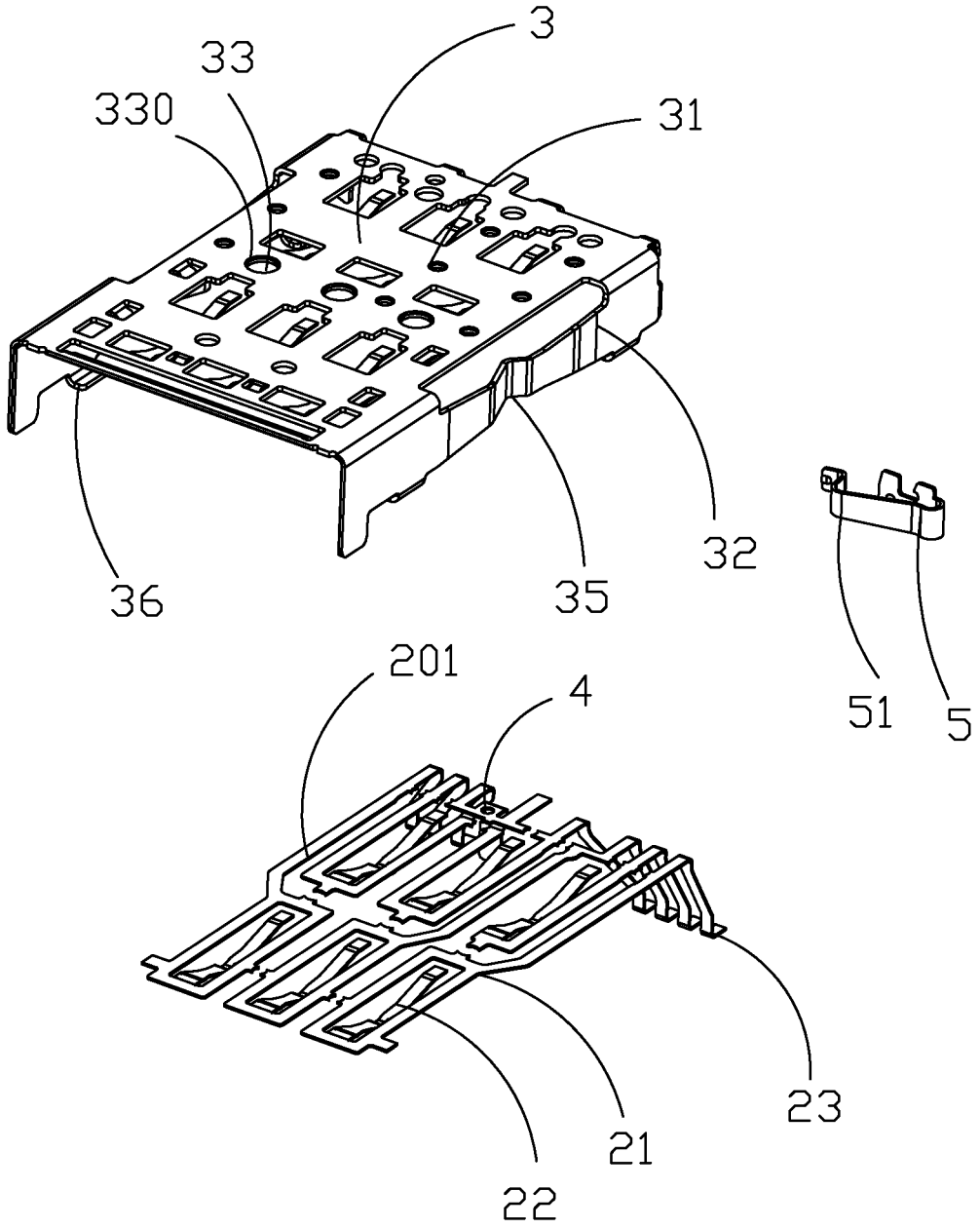
FIG. 6 is a partially exploded perspective view of a part of the electronic card connector.
Figure 7:
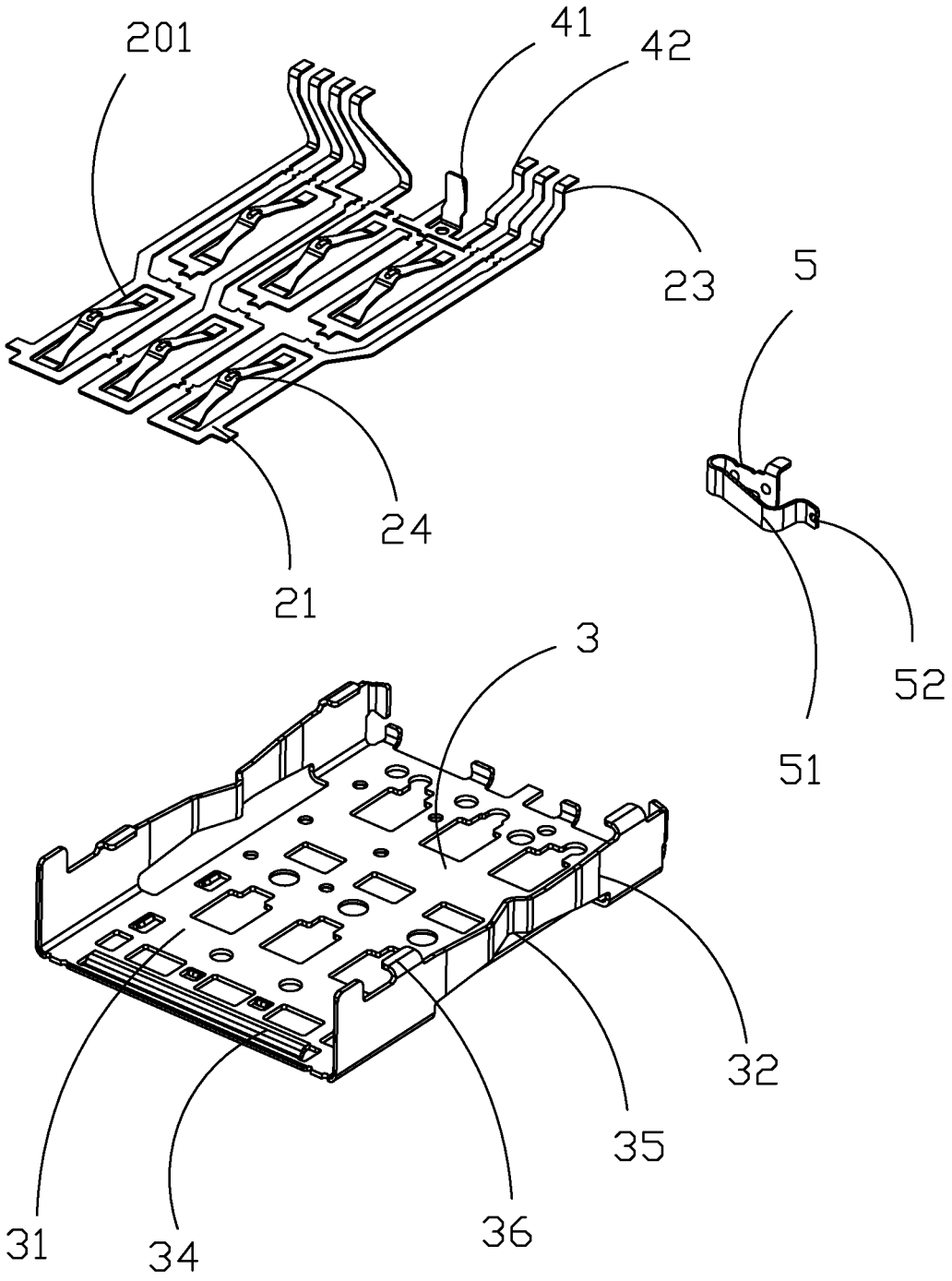
FIG. 7 is another partially exploded perspective view of the part of the electronic card connector of FIG. 6.
Figure 8:
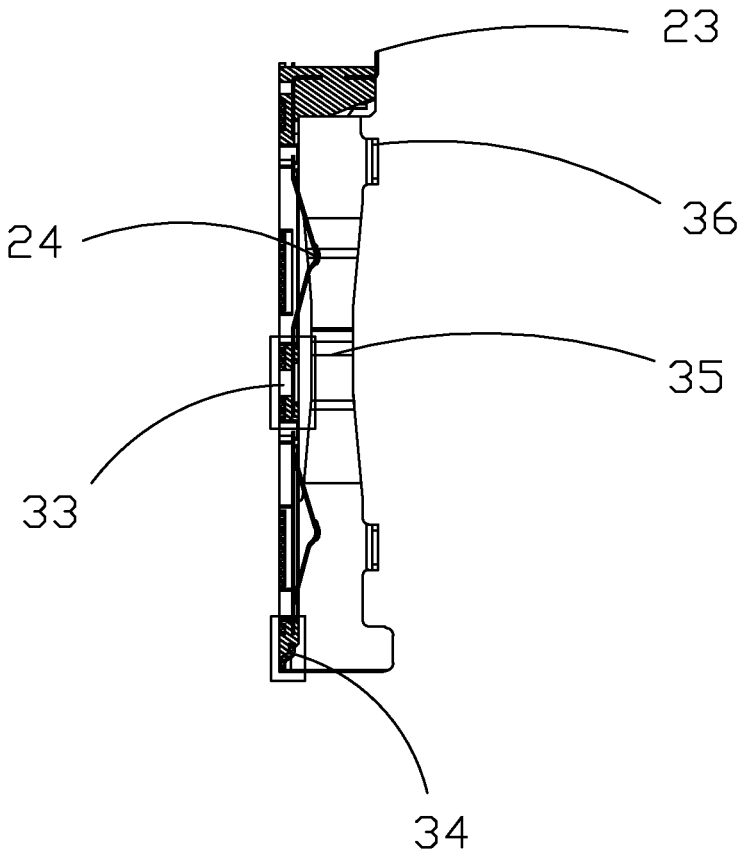
FIG. 8 is a cross-sectional view of the part of the electronic card connector taken along line 5-5 of FIG. 5.

FIGS. 1 to 3 show an electronic card connector assembly 100 in a first embodiment mounted into a printed circuit board (not figured), and the electronic card connector assembly 100 includes an electronic card connector and a card tray 7 inserted into the electronic card connector. The electronic card connector includes an insulative housing, a number of conductive terminals retained in the insulative housing, and a shielding shell 3 attached to the insulative housing. In the first embodiment of this present disclosure, an accommodating cavity 101 is formed between the shielding shell 3 and the insulative housing along an insertion direction for the card tray 7 insertion.

Figure 11:
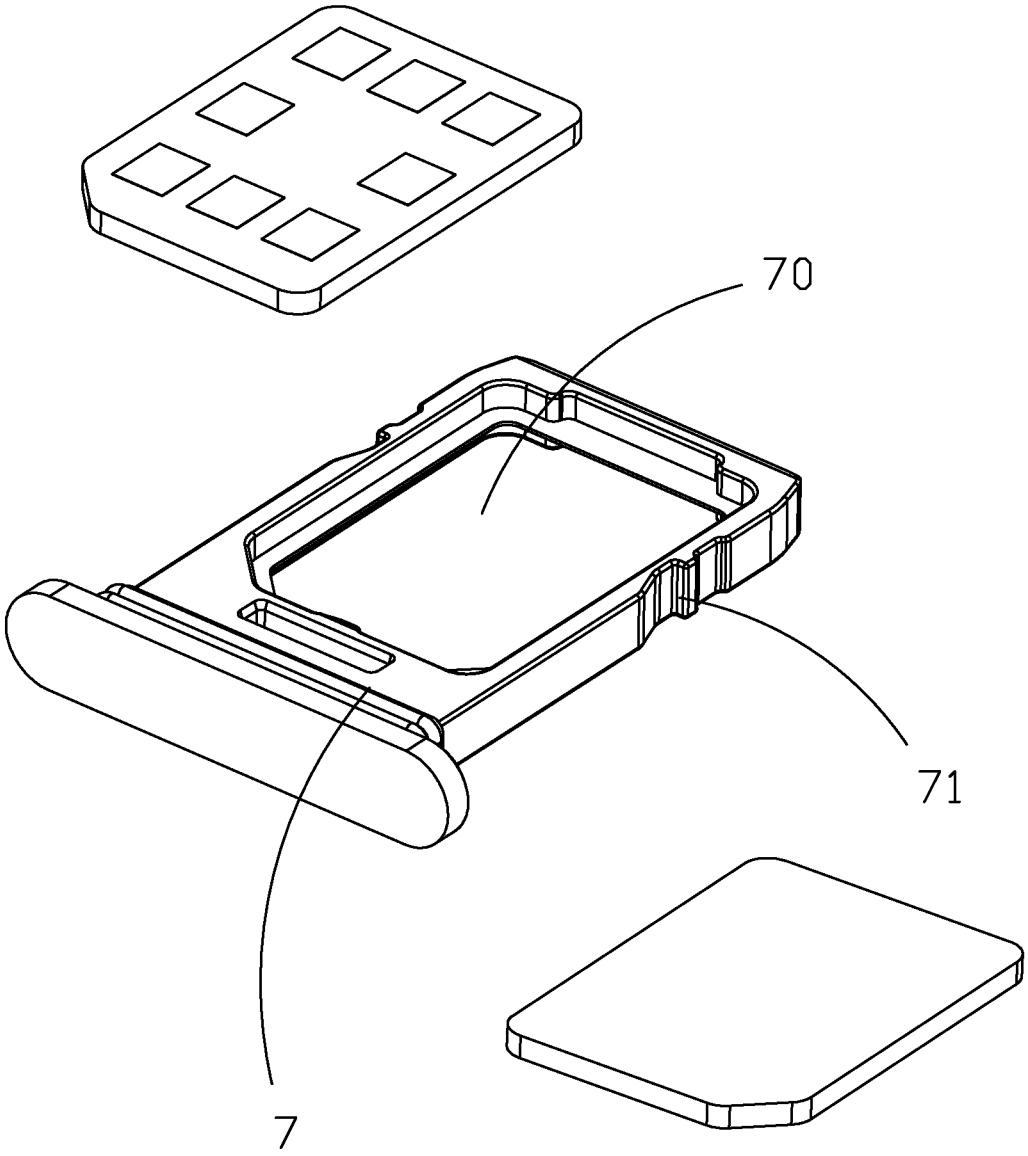
FIG. 11 is an exploded perspective view of a card tray of the electronic card connector assembly.
Figure 12:
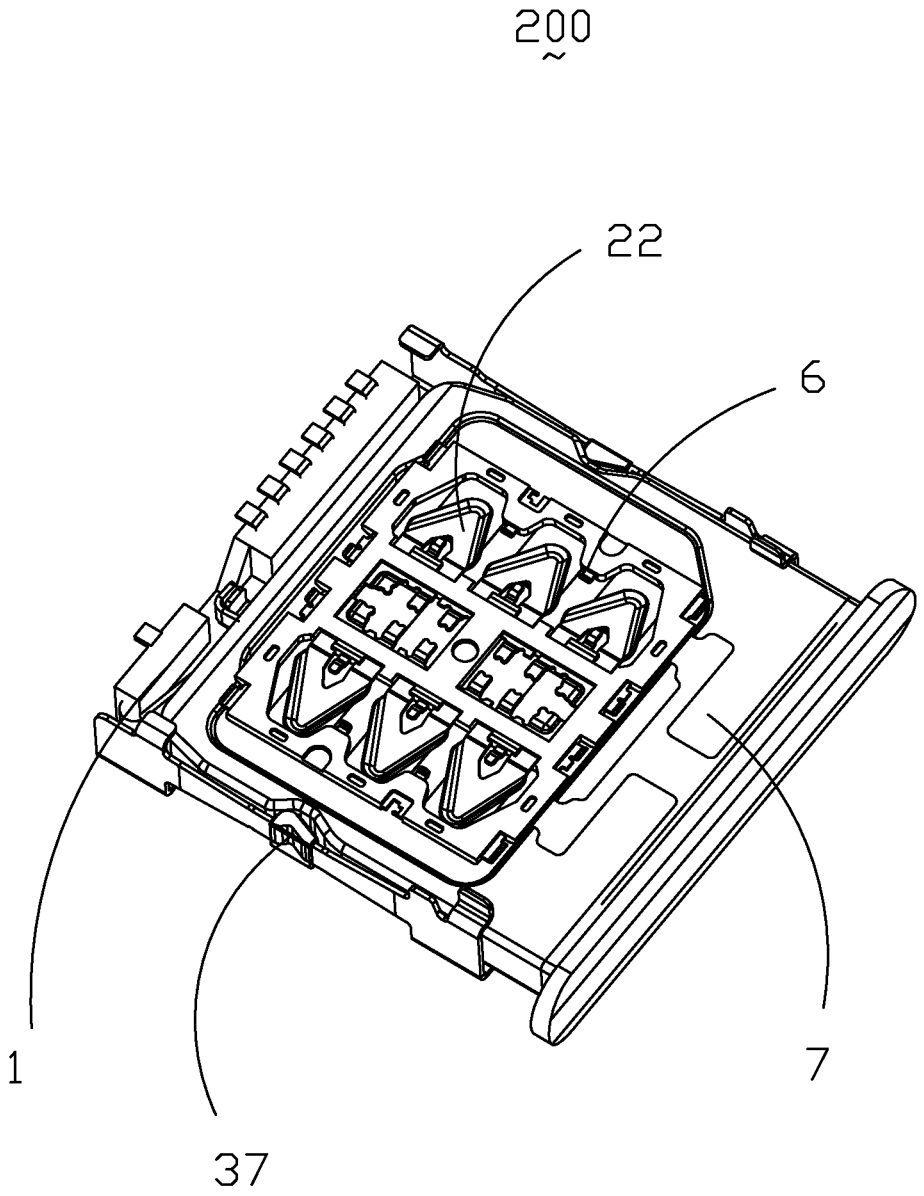
FIG. 12 is an assembled perspective view of an electronic card connector assembly in a second embodiment.
Figure 13:
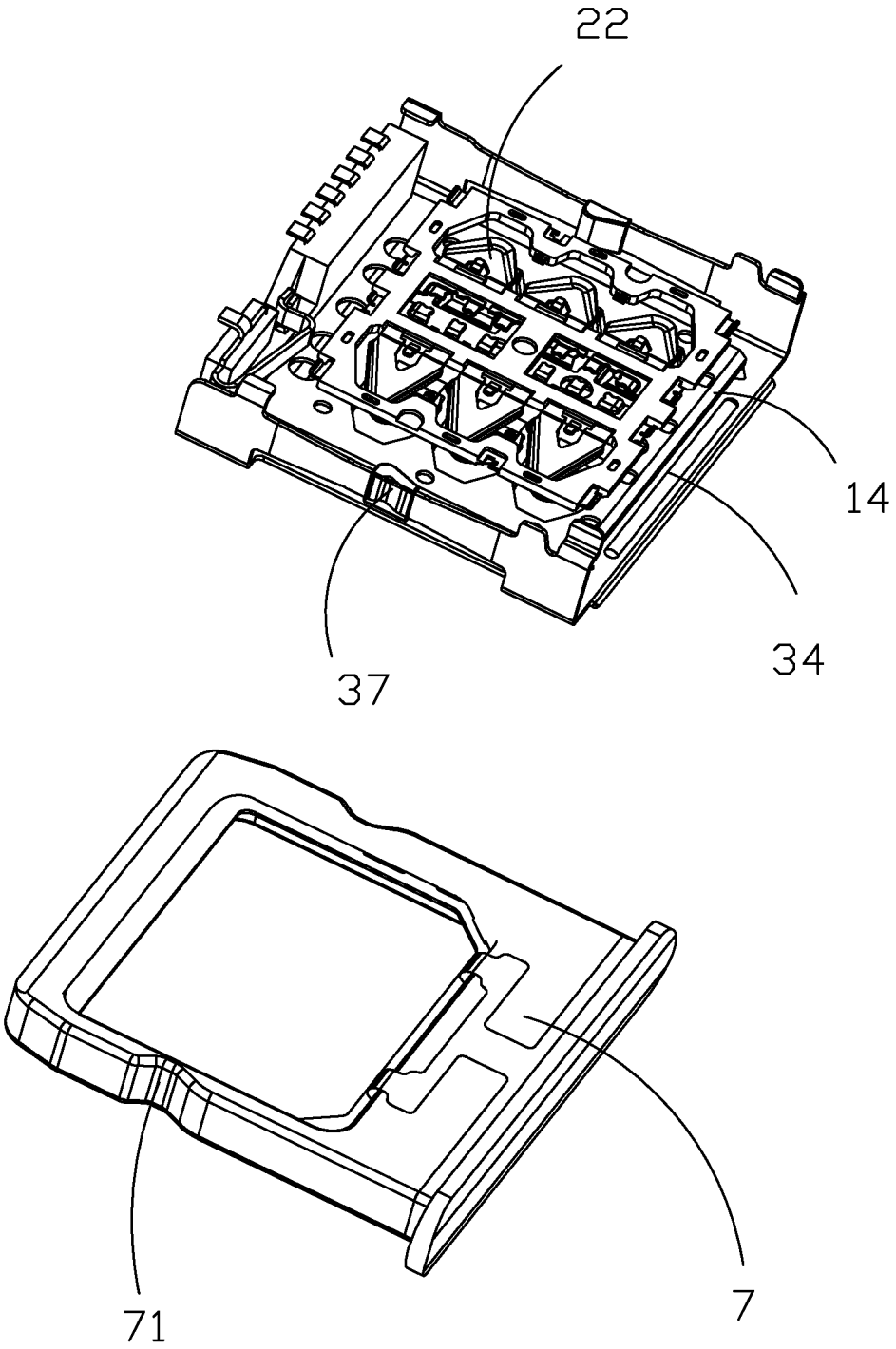
FIG. 13 is a partially exploded perspective view of the electronic card connector assembly of FIG. 12.

Referring to FIGS. 11 to 13, the card tray 7 has a supporting portion receiving an electronic card and a panel portion located behind the supporting portion. The supporting portion is received in the accommodating cavity 101, and the panel portion is located outside of the insulative housing. The supporting portion of the card tray 7 includes a pair of card-receiving grooves 70 respectively located in an upper surface and a lower surface thereof. The pair of card-receiving grooves 70 is of centro-symmetric distribution and owns the same structure so that disregarding the insertion orientations of the card tray 7, the conductive terminals are always electrically connected with pins of the electronic card correctly. Moreover, as a free end of the panel portion with a corresponding free end of the supporting portion in a transverse direction perpendicular to the insertion direction has the same distance with the other free end of the panel portion with a corresponding free end of the supporting portion in a transverse direction perpendicular to the insertion direction, there is no need to increase a mistake-proofing structure. The structure of the card tray 7 is convenient to be used by customers and decreases the manufacturing costs.

Referring to FIGS. 2 to 5, the conductive terminals include an array of first contacts 201 and an array of second contacts 202 configured in two rows in a vertical direction perpendicular to the insertion direction and the transverse direction. The first contacts 201 are punching-and-blanking molded in a material ship, and the second contacts 202 are punching-and-blanking molded in another material strip.

The insulative housing includes a first base body 1 injection-molded with the first contacts 201 and a second base body 6 injection-molded with the second contacts 202. The first base body 1 is configured separately with the second base body 6, and the accommodating cavity 101 is located between the first base body 1 and the second base body 6 in the vertical direction. Therefore, the first base body 1 and the second base body 6 can be assembled individually or in combination to meet the needs of different customers and decreases the manufacturing costs.

The first base body 1 is equipped with a main portion 11 and a rear portion 12 located behind the main portion 11. The accommodating cavity 101 is located under the main portion 11. In the molding process, the material strip of the first contacts 201 is insert-molded in the first base body 1, then the first contacts 201 connected to the material strip are cut out with each other. The accommodating cavity 101 is located above the second base body 6. In the molding process, the material ship of the second contacts 202 is insert-molded in the second base body 6, then the second contacts 202 connected to the material strip are cut out with each other.

Referring to FIGS. 5 to 8, each conductive terminal includes an affixed portion 21 retained in the insulative housing, an elastic portion 22 extending into the accommodating cavity 101 from the affixed portion 21, and a soldering portion 23 extending outside of the insulative housing. The elastic portion 22 has a contacting portion 24 electrically connected with the electronic card of the card tray 7. The contacting portions 24 of the first contacts 201 are extending downwardly into the accommodating cavity 101, and the contacting portions 24 of the second contacts 202 are extending upwardly into the accommodating cavity 101. Furthermore, the contacting portion 24 of each first contact 201 is corresponding to the contacting portions 24 of each second contact 202 in the vertical direction, so that the card tray 7 can be inserted into the insulative housing either in an obverse side or in a reverse side. In other word, the card tray 7 can be inserted into the insulative housing in a rotationally symmetrical direction in 180 degree. Therefore, the card tray 7 inserted into the insulative housing in two sides can avoid being inserted into the insulative housing by mistake. Moreover, the accommodating cavity 101 is located between the first base body 1 and the second base body 6 without mechanical components, which decreases the total height of the electronic card connector and complies to a thinness tendency of the electronic card connector.

The first contacts 201 are configured in two rows in the insertion direction, and the second contacts 202 have the same configuration. The elastic portions 22 of the conductive terminals are extending into the accommodating cavity 101 along the insertion direction, and available to move toward the rear portion 12 of the insulative housing 1 so as to be connected with the corresponding electrical card. The soldering portions 23 of the first contacts 201 are configured in a row in the transverse direction and extending outside of the rear portion 12 of the first base body 1 to locate in a same plane with the soldering portions 23 of the first contacts 202.

Figure 9:
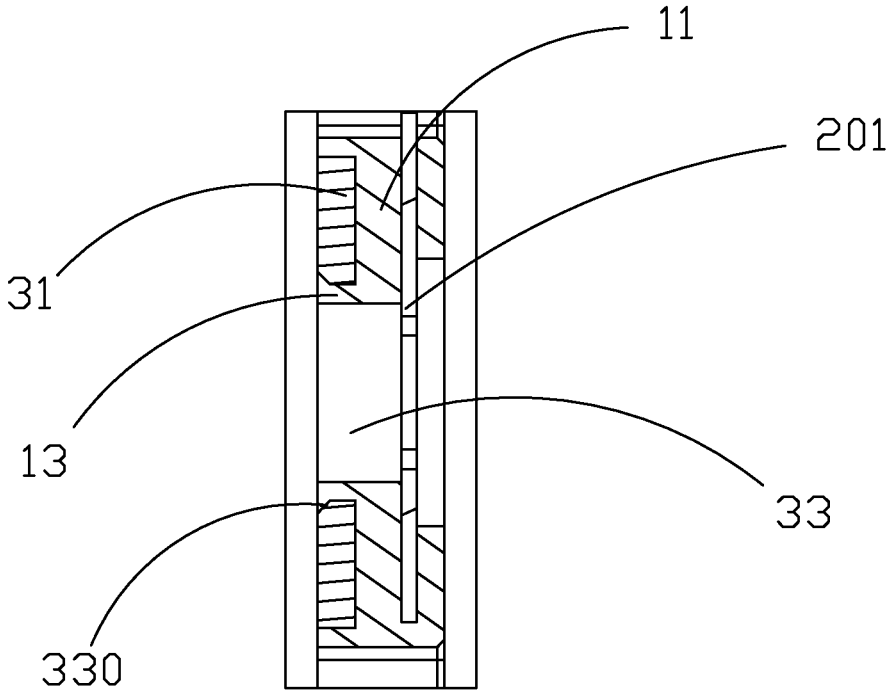
FIG. 9 is a partial enlarged view of the part of FIG. 8.
Figure 10:
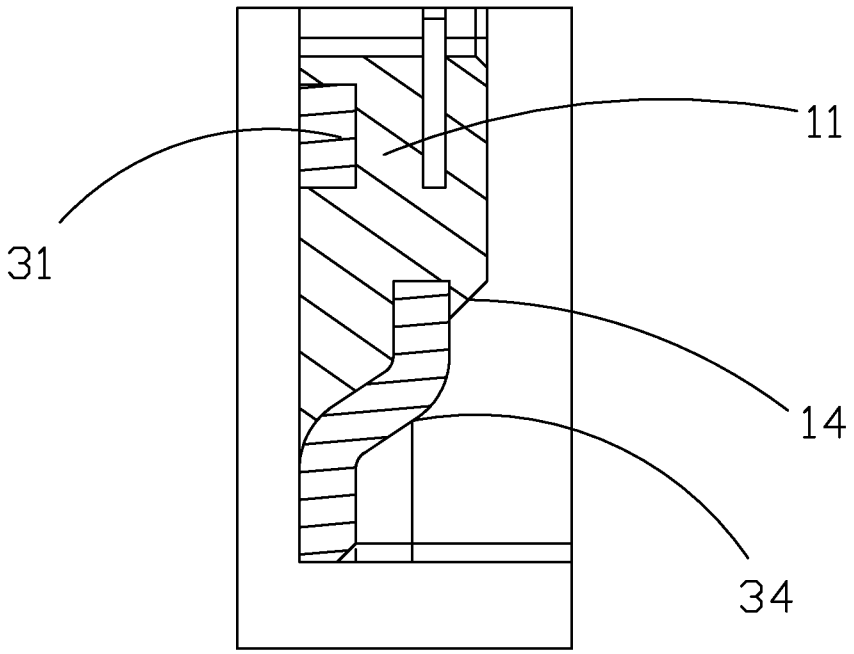
FIG. 10 is another partial enlarged view of the part of FIG. 8.

Referring to FIGS. 9 to 10, the shielding shell 3 forms a top wall 31 and a pair of side walls 32 bent downwardly from two opposite ends of the top wall 31. The first contacts 201 with the first base body 1 is affixed to the top wall 31. The top wall 31 has a number of holes 33 running through an upper surface and a lower surface thereof, a guiding portion 34 located in front thereof and extending into the accommodating cavity 101, and a number of chamfers 330 located in an inner surface of the holes 33 and gradually broadening from the lower surface to the upper surface. The first base body 1 includes a number of protrusions 13 abutting against the chamfers 330, and the pyramid shape of the protrusions 13 allows it to occupy the corresponding chamfer 330. The first contacts 201 is inject-molded with the shielding shell 3 and the first base body 1 so as to further decrease the height of the insulative housing and the shielding shell 3, and comply to miniaturization tendency. Therefore, it obtains a good firmness between the insulative housing and the shielding shell 3 and ensures the flatness of the top wall 31 of the shielding shell 3. The holes 33 are used for positioning die when the first base body 1 is injection molding, and the protrusions 13 fix the first base body 1 to the top wall 31 of the shielding shell 3 firmly.

The guiding portion 34 is bent from the top wall 31 and extending inwardly and obliquely into the accommodating cavity 101 to guide the electrical card to insert into the insulative housing. The first base body 1 has an incline portion 14 located in the front of the main portion 11, and a lower surface of the incline portion 14 is lower than a lower surface of the guiding portion 34 of the shielding shell 3. The guiding portion 34 is located in front of the incline portion 14 and partially embedded in the first base body 1. When the card tray 7 is inserted in the insulative housing, the card tray 7 is guided by the guiding portion 34 of the shielding shell 3 and sliding into the accommodating cavity 101 along the incline portion 14 of the first base body 1. Therefore, the card tray 7 is less likely to crash or scrape to the main portion 11 of the first base body 1 during the insertion.

Each side wall 32 of the shielding shell 3 has a resisting portion 35 with resilience and a number of tail portions 36 mounted to the printed circuit board. The resisting portion 35 is separated from the top wall 31 and protruding into the accommodating cavity 101. When the card tray 7 is inserted into the insulative housing, the resisting portion 35 is locked in a resisting slot 71 of the card tray 7 to firmly lock. The tail portions 36 and the soldering portions 23 are located in a same plane to be mounted to the printed circuit board to ensure the electronic card connector affixed to the printed circuit board firmly.

The electronic card connector further includes a detecting contact 4 inject-molded with the first base body 1 and an elastic contact 5 retained in the rear portion 12. The detecting contact 4 is punching-and-blanking molded in the same material strip with the first contacts 201 and has a connecting portion 41 exposed on the rear portion 12 and a soldering leg 42 extending outside of the rear portion 12. The soldering leg 42 of the detecting contact 4 and the soldering portions 23 of the conductive terminals are arranged in a row. The elastic contact 5 includes a main portion 51 extending curvedly into the accommodating cavity 101 and a retained portion 52 connected with a free end of the main portion 51 and abutting against the connecting portion 41. While the card tray 7 is absent from the accommodating cavity 101, the retained portion 52 is abutting against the connecting portion 41. While the card tray 7 is received in the accommodating cavity 101, the card tray 7 pushes the elastic contact 5 rearwardly so as to separate the retained portion 52 from the connecting portion 41.

The contacting portions 24 of the first contacts 201 are configured corresponding to the contacting portions 24 of the second contacts 202 in the vertical direction, so that the card tray 7 can be inserted into the insulative housing either in an obverse side or in a reverse side. In other word, the card tray 7 can be inserted into the insulative housing in a rotationally symmetrical direction in 180 degree. Therefore, the card tray 7 inserted into the insulative housing in two sides can avoid being inserted into the insulative housing by mistake. Moreover, as a free end of the panel portion with a corresponding free end of the supporting portion in the transverse direction perpendicular to the insertion direction has the same distance with the other free end of the panel portion with a corresponding free end of the supporting portion in the transverse direction, there is no need to increase a mistake-proofing structure. The structure of the card tray 70 is convenient to be used by customers and decreases the manufacturing costs.

FIGS. 12 and 13 show an electronic card connector 200 in a second embodiment. The structure of the electronic card connector 200 is the same as the electronic card connector in first embodiment in general and the difference therebetween is as follows.

The guiding portion 34 of the shielding shell 3 shapes like a rib extending into the accommodating cavity 101 from the top wall 31 so as to enhance the intensity of the shielding shell 3. The guiding portion 34 is located in front of the incline portion 14 and forms a gap with first base body 1. The first contacts 201 are configured in two rows and the second contacts 202 have the same configuration. The elastic portions 22 of the first contacts 201 and the second contacts 202 extend into the accommodating cavity 101 in the transverse direction and are configured face-to-face. The electronic card connector 200 further includes an insulator 37 inject-molded with the resisting portion 35 and extending into the accommodating cavity 101.

In the present disclosure, the first base body 1 inject-molded with the first contacts 201 and the shielding shell 3 is viewed as a whole, and forms the accommodating cavity 101 with the second base body 6 inject-molded with the second contacts 202. It is convenient for customers to assemble the components and insert the card tray 7 in two sides. In other embodiment, the first base body 1 inject-molded with the first contacts 201 and the shielding shell 3 can form the accommodating cavity 101 with the printed circuit board to decrease the height of the electronic card connector. The first base body 1 with the first contacts 201 is assembled in the top wall 31 of the shielding shell 3, the side walls 32 has the tail portions 36 mounted into the printed circuit board, and the shielding shell 3 with the first base body 1 and the printed circuit board forms the accommodating cavity 101 to decrease the height of the electronic card connector and comply to miniaturization tendency. The first base body 1 and the second base body 6 are located at two opposite sides of the accommodating cavity 101 in the vertical direction and separated from each other. Therefore, the second base body 6 can be removed from the first base body 1, which is convenient to increase the space for the electronic card connector to cooperate with other components and meets different needs of customers. As an example, the first base body 1 can be cooperated with a connector besides the second base body 6. The electronic card connector of the present disclosure has diversified applications, so that there is no need to prepare different moulds and it decreases the manufacturing costs of the moulds.

However, the disclosure is illustrative only, changes may be made in detail, especially in matter of shape, size, and arrangement of parts within the principles of the disclosure.

What is claimed is:

1. An electronic card connector, used for receiving a card tray able to receive an electronic card either in two sides, comprising:

an insulative housing defining an accommodating cavity receiving the card tray, and having a first base body;

a plurality of conductive terminals retained in the insulative housing, and defining an array of first contacts and an array of second contacts respectively located in two sides of the accommodating cavity in a vertical direction, each terminal having an affixed portion retained in the insulative housing, a contacting portion extending into the accommodating cavity from the affixed portion, and a soldering portion extending outside of the insulative housing; and a shielding shell attached to the insulative housing, the shielding shell having a top wall, wherein the top wall has a guiding portion located in the front thereof and extending into the accommodating cavity, and the guiding portion is located in front of an upper part of the insulative housing;

wherein the insulative housing is inject-molded with the first contacts and the shielding shell, the first contacts are configured as same as the second contacts in a rotationally symmetrical direction in 180 degree so that disregarding the insertion orientations of the card tray, the conductive terminals are always electrically connected with pins of the electronic card correctly.

2. The electronic card connector accordingly to claim 1, wherein the insulative housing has a second base body inject-molded with the second contacts, and the first base body and the second base body are separated from each other and located in two opposite sides of the accommodating cavity in the vertical direction.

3. The electronic card connector accordingly to claim 2, wherein the first base body is equipped with a rear portion at a rear end thereof, the electronic card connector further includes a detecting contact inject-molded with the first base body and an elastic contact retained in the rear portion, the detecting contact is punching-and-blanking molded in the same material strip with the first contacts and has a connecting portion exposed to the rear portion and a soldering leg extending outside of the rear portion, the soldering leg of the detecting contact and the soldering portions of conductive terminals are located in a row, and the elastic contact includes a main portion extending curvedly into the accommodating cavity and a retained portion connected with a free end of the main portion and resisted against by a rear end of the connecting portion.

4. The electronic card connector accordingly to claim 2, wherein the shielding shell has a top wall inject-molded with the first base body and a pair of side walls bent downwardly from two opposite ends of the top wall, the top wall has a plurality of holes running through an upper surface and a lower surface thereof and a plurality of chambers located in an inner surface of the holes and gradually broadening from the lower surface to the upper surface thereof, and the first base body has a plurality of protrusions resisting against the corresponding chambers.

5. The electronic card connector accordingly to claim 4, wherein the side walls each has a plurality of resisting portions protruding into the accommodating cavity, the electronic card connector has insulator inject-molded with the resisting portions and extending into the accommodating cavity to lock the card tray.

6. The electronic card connector accordingly to claim 1, wherein the contacting portions of the conductive terminals extend into the accommodating cavity in an insertion direction perpendicular to the vertical direction, and extend towards a rear end of the insulative housing.

7. The electronic card connector accordingly to claim 6, wherein the first contacts are configured in two rows, and the contacting portions of the two rows of the first contacts are extending into the accommodating cavity in a transverse direction perpendicular to the vertical direction and the insertion direction and corresponding to each other.

8. The electronic card connector accordingly to claim 7, wherein the first contacts are punching-and-blanking molded in a material strip, the second contacts are punching-and-blanking molded in another material strip, and the soldering portions of the first contacts are configured in a row in the transverse direction and located in a same plane with the soldering portions of the second contacts.

9. An electronic card connector assembly, used for receiving an electronic card, and having an electronic card connector and a card tray, the electronic card connector comprising:

an insulative housing, defining a first base body, a second base body, and an accommodating cavity between the first base body and the second base body;

a plurality of conductive terminals retained in the insulative housing, and each conductive terminal having a contacting portion extending into the accommodating cavity and a soldering portion extending outside of the insulative housing; and a shielding shell attached to the insulative housing, the shielding shell having a top wall, wherein the top wall has a guiding portion located in the front thereof and extending into the accommodating cavity, and the guiding portion is located in front of an upper part of the insulative housing;

wherein the card tray has a supporting portion receiving an electronic card and a panel portion located behind the supporting portion, the supporting portion is received in the accommodating cavity, and the panel portion is located outside of the insulative housing;

wherein the first base body is inject-molded with the first contacts and the shielding shell, and the first contacts are configured as same as the second contacts in a rotationally symmetrical direction in 180 degree, the contacting portions of the conductive terminals are always electrically connected with pins of the electronic card correctly, the contacting portions of the conductive terminals are able to connect with the electronic card of either side of the card tray, and a free end of the panel portion with a corresponding free end of the supporting portion in a transverse direction has the same distance with the other free end of the panel portion with a corresponding free end of the supporting portion in the transverse direction.

10. The electronic card connector assembly accordingly to claim 9, wherein the card tray has a pair of card-receiving grooves respectively located in an upper surface and a lower surface thereof, the pair of card-receiving grooves is of centro-symmetric distribution and owns the same structure.

11. An electronic card connector, mounted in a printed circuit board, comprising:

a first base body;

a plurality of first contacts retained in the first base body, each first contact having an affixed portion retained in the first base body, a contacting portion and a soldering portion extending outside of the first base body; and a shielding shell attached to the first base body, the shielding shell having a top wall and a pair of side walls bent downwardly from two opposite ends of the top wall, the first base body inject-molded with the first contacts and the top wall, each side wall having a plurality of tail portions mounted to the printed circuit board wherein the top wall has a guiding portion located in the front thereof and extending into the accommodating cavity, and the guiding portion is located in front of the first base body;

wherein the first base body, the shielding shell and the printed circuit board together form an accommodating cavity for receiving an electronic card along an inserted direction, and the contacting portions are extending into the accommodating cavity.

12. The electronic card connector accordingly to claim 11, wherein the top wall has a plurality of holes running through an upper surface and a lower surface thereof and a plurality of chamfers located in an inner surface of the holes and gradually broadening from a lower surface to an upper surface, and the first base body has a plurality of protrusions resisting against the chamfers, and the pyramid shape of the protrusions allows to occupy the corresponding chamfer.

13. The electronic card connector accordingly to claim 11, wherein the guiding portion shapes like a rib extending into the accommodating cavity from the top wall.

14. The electronic card connector accordingly to claim 11, wherein the guiding portion shapes like a shrapnel bent separately from the top wall and extending inwardly and obliquely into the accommodating cavity.

15. The electronic card connector accordingly to claim 11, wherein the first base body has an incline portion located in the front thereof, a lower surface of the incline portion is lower than a lower surface of the guiding portion of the shielding shell, and the guiding portion is located in front of the incline portion and partially embedded in the first base body.

16. The electronic card connector accordingly to claim 11, wherein the soldering portions of the first contacts are configured in a row in a transverse direction perpendicular to the inserted direction, and the soldering portions are lower than the affixed portions in a vertical direction perpendicular to the inserted direction and the transverse direction.

17. The electronic card connector accordingly to claim 11, wherein each side wall of the shielding shell has a resisting portion with resilience, and the electronic card connector further has an insulator inject-molded with the resisting portion and extending into the accommodating cavity.

18. The electronic card connector accordingly to claim 11, wherein first base body is equipped with a rear portion at a rear end thereof, the electronic card connector further includes a detecting contact inject-molded with the first base body and an elastic contact retained in the rear portion, the detecting contact is punching-and-blanking molded in the same material strip with the first contacts and has a connecting portion exposed to the rear portion and a soldering leg extending outside of the rear portion, the soldering leg of the detecting contact and the soldering portions of the first contacts are located in a row.

19. The electronic card connector accordingly to claim 18, wherein the elastic contact includes a main portion extending curvedly into the accommodating cavity and a retained portion connected with a free end of the main portion and resisted against by a rear end of the connecting portion in the inserted direction.

* * * * *